US008342975B1

(12) United States Patent
Bishop

(10) Patent No.: US 8,342,975 B1
(45) Date of Patent: Jan. 1, 2013

(54) OCCUPANT PROPELLED ROUNDABOUT

(76) Inventor: Michael Bishop, Brookton, MA (US)

( * ) Notice: Subject to any disclaimer, the term of this patent is extended or adjusted under 35 U.S.C. 154(b) by 303 days.

(21) Appl. No.: 12/874,384

(22) Filed: Sep. 2, 2010

(51) Int. Cl.
*A63G 1/22* (2006.01)
*A63G 1/12* (2006.01)

(52) U.S. Cl. ..... 472/21; 472/26

(58) Field of Classification Search ..... 472/14, 472/19–26, 4, 5, 108
See application file for complete search history.

(56) References Cited

U.S. PATENT DOCUMENTS

| | | | | | |
|---|---|---|---|---|---|
| 196,753 | A | * | 11/1877 | Hawthorne | 472/4 |
| 540,127 | A | * | 5/1895 | Weston | 472/20 |
| 832,459 | A | | 10/1906 | Cruz | |
| 1,643,097 | A | * | 9/1927 | Stewart et al. | 472/22 |
| 2,537,176 | A | * | 1/1951 | Vlahov | 472/24 |
| 3,672,669 | A | | 6/1972 | Ottaviano | |
| 3,858,871 | A | | 1/1975 | Bourne | |
| 4,428,576 | A | | 1/1984 | Fisher, Jr. | |
| D287,262 | S | | 12/1986 | McNutt et al. | |
| 5,011,133 | A | * | 4/1991 | Myers, Sr. | 472/21 |
| 5,246,400 | A | | 9/1993 | Klucik | |
| 5,607,359 | A | | 3/1997 | Farmer, Sr. | |

* cited by examiner

*Primary Examiner* — Kien Nguyen
(74) *Attorney, Agent, or Firm* — Goldstein Law Offices, P.C.

(57) ABSTRACT

One embodiment of an occupant propelled roundabout ("roundabout") may have a body. The roundabout may also have a carrier, which may be rotatably carried by the body and may also have a seat assembly adapted to carry an occupant. In addition, the roundabout may also have a drive mechanism pivotally coupled to the seat assembly such that the drive mechanism may be movable between a deployed position and a retracted position. The drive mechanism may be moved toward the deployed position in response to the occupant operating the drive mechanism. Also, the roundabout may have a biasing member, which may be operably connected between the drive mechanism and the carrier so that the biasing member may move the drive mechanism toward the retracted position.

20 Claims, 6 Drawing Sheets

OCCUPANT PROPELLED ROUNDABOUT

FIELD OF THE DISCLOSURE

The present disclosure generally relates to amusement devices, and more particularly to an occupant propelled roundabout having a drive mechanism that is movable between a deployed position and a retracted position.

BACKGROUND OF THE DISCLOSURE

Because of our desire to be entertained, thrilled, and stimulated, a wide variety of amusement devices, rides, and vehicles have been created. Such devices exist both in public settings such as amusement parks, municipal parks, and schools—and in private settings such as backyard swing-sets and "jungle gyms", etc. A key element in all such devices is providing an experience of fun for the user, whether they are a child, an adolescent, or an adult. The most classic forms of such devices provide the thrill of motion, including from see-saws, merry-go-rounds, swings, slides, and the like. Perhaps the most popular of these are self-propelled—since they place the user in charge of the intensity of the ride they experience.

Early occupant propelled amusement devices required an operator to continuously move those devices at a desired speed while he or she and any other occupants may enjoy the ride. One example of these devices may include a bicycle driven merry-go-round, which may have a center post, a platform rotatably carried by the center post and one or more bicycles secured to the platform. In use, an operator may operate the bicycle thereby spinning the platform about the center post and permitting occupants on the platform to enjoy the ride. The bicycles may spin the platform provided that the operators continuously operate their respective bicycles because the rolling friction associated with the bicycles may quickly decelerate the platform when the operators elect to cruise rather than pedal.

Most recent merry-go-rounds do not use the bicycles and require and individual to run alongside the platform to push it until it reaches a desired speed and then jump onto the platform to enjoy the ride along with other occupants on the platform. However, it may require more energy to spin these merry-go-rounds as compared to the predecessor merry-go-rounds that included bicycles. In addition, it may be somewhat difficult to board the platform after pushing it to spin at a generally high speed.

SUMMARY OF THE INVENTION

One embodiment of an occupant propelled roundabout ("roundabout") may have a body. The roundabout may also have a carrier, which may be rotatably carried by the body and may also have a seat assembly adapted to carry an occupant. In addition, the roundabout may also have a drive mechanism pivotally coupled to the seat assembly such that the drive mechanism may be movable between a deployed position and a retracted position. The drive mechanism may be moved toward the deployed position in response to the occupant operating the drive mechanism. Also, the roundabout may have a biasing member, which may be operably connected between the drive mechanism and the carrier so that the biasing member may move the drive mechanism toward the retracted position.

Another embodiment of a roundabout may have a body that may include a base. In addition, the body may also include a post extending from the base. The roundabout may also have a carrier, which may include a cross bar rotatably carried by the post. The carrier may also have a first pillar carried by one end of the cross bar and a second pillar carried by the other end of the cross bar. Furthermore, the carrier may have a first seat assembly, which may be carried by the first pillar and may also be adapted to carry a first occupant. The roundabout may also have a first drive mechanism, which may be pivotally coupled to the first seat assembly and may be movable between a deployed position and a retracted position. The first drive mechanism may be moved toward the deployed position in response to the first occupant operating the first drive mechanism. The roundabout may also have a first biasing member that may be operably connected between the first drive mechanism and the carrier. The first biasing member may move the first drive mechanism toward its retracted position. Also, the carrier may have a second seat assembly, which may be carried by the second pillar and may also be adapted to carry a second occupant. The roundabout may also have a second drive mechanism, which may be pivotally coupled to the second seat assembly and may also be movable between a deployed position and a retracted position. The second drive mechanism may be moved toward the deployed position in response to the second occupant operating the second drive mechanism. The roundabout may also have a second biasing member that may be operably connected between the second drive mechanism and the carrier. The second biasing member may move the second drive mechanism toward its retracted position.

One embodiment of a method for operating an occupant propelled roundabout may include supporting an occupant on a seat assembly. The method may also include operating a drive mechanism pivotally carried by the seat assembly, such that the drive mechanism moves toward a deployed position and a wheel of the drive mechanism accelerates the roundabout with respect to the ground. In addition, the method may include disengaging the drive mechanism such that a biasing member moves the drive mechanism toward a retracted position.

BRIEF DESCRIPTION OF THE DRAWINGS

The advantages and features of the present disclosure will become better understood with reference to the following detailed description and claims taken in conjunction with the accompanying drawing, in which:

Like reference numerals refer to like parts throughout the description of several views of the drawings.

DETAILED DESCRIPTION OF THE DISCLOSURE

Figure 1:
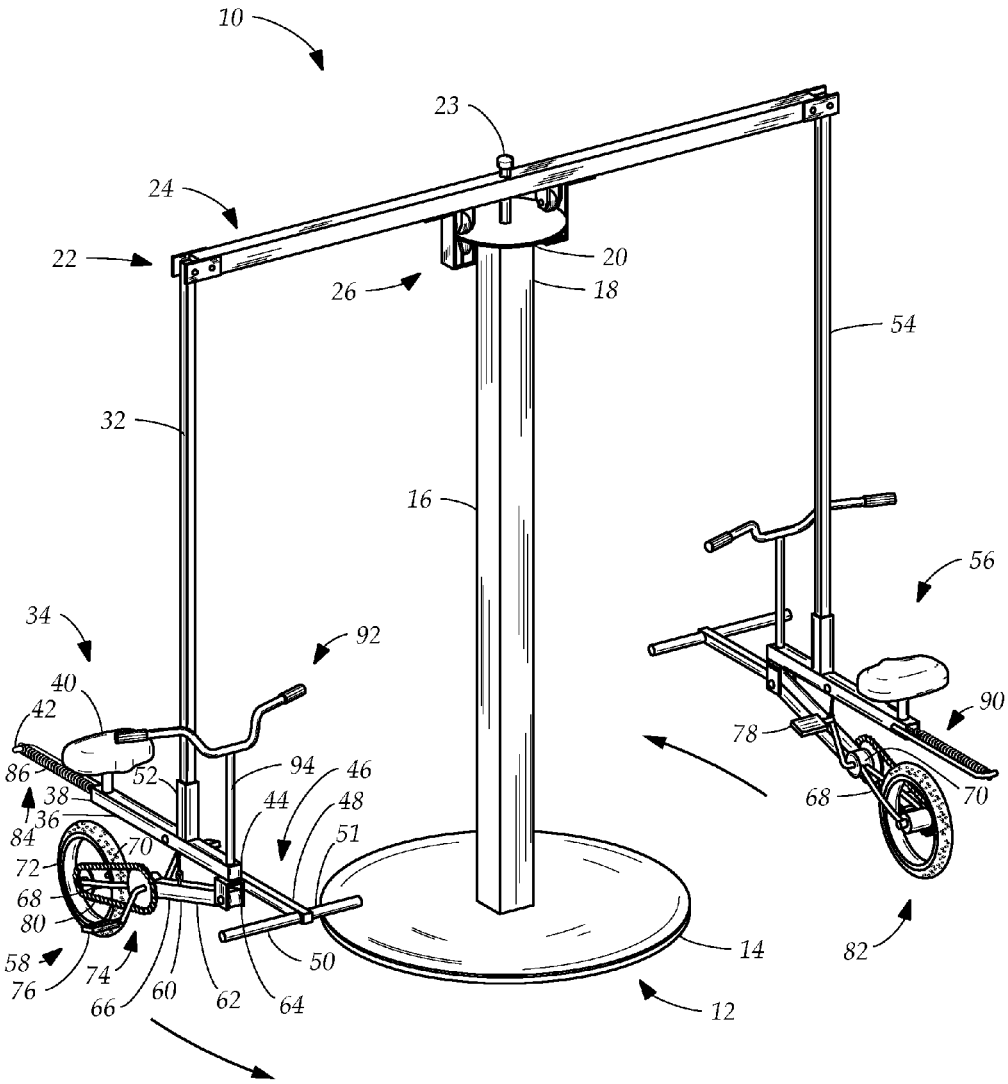
FIG. 1 is a perspective view of one embodiment of an occupant propelled roundabout having a pair of seat assemblies, a pair of drive mechanisms and a pair of biasing members.

FIG. 1 illustrates an occupant propelled roundabout 10 ("roundabout") having a body 12, which in this form may be a central spindle member including a base 14. The base 14 may be a generally flat disc. Of course, the base may instead be other suitable foundations, such as a series of legs extending radially outward from a common hub or center. The body 12 has a post 16 extending upwardly from the base 14. The post 16 in one form may be a hollow tube that terminates at an end 18 with an annular flange 20 or round plate. The post, however, may be other support structures that may include, for example, a central frame including an outer periphery having a circuitous track.

Figure 2:
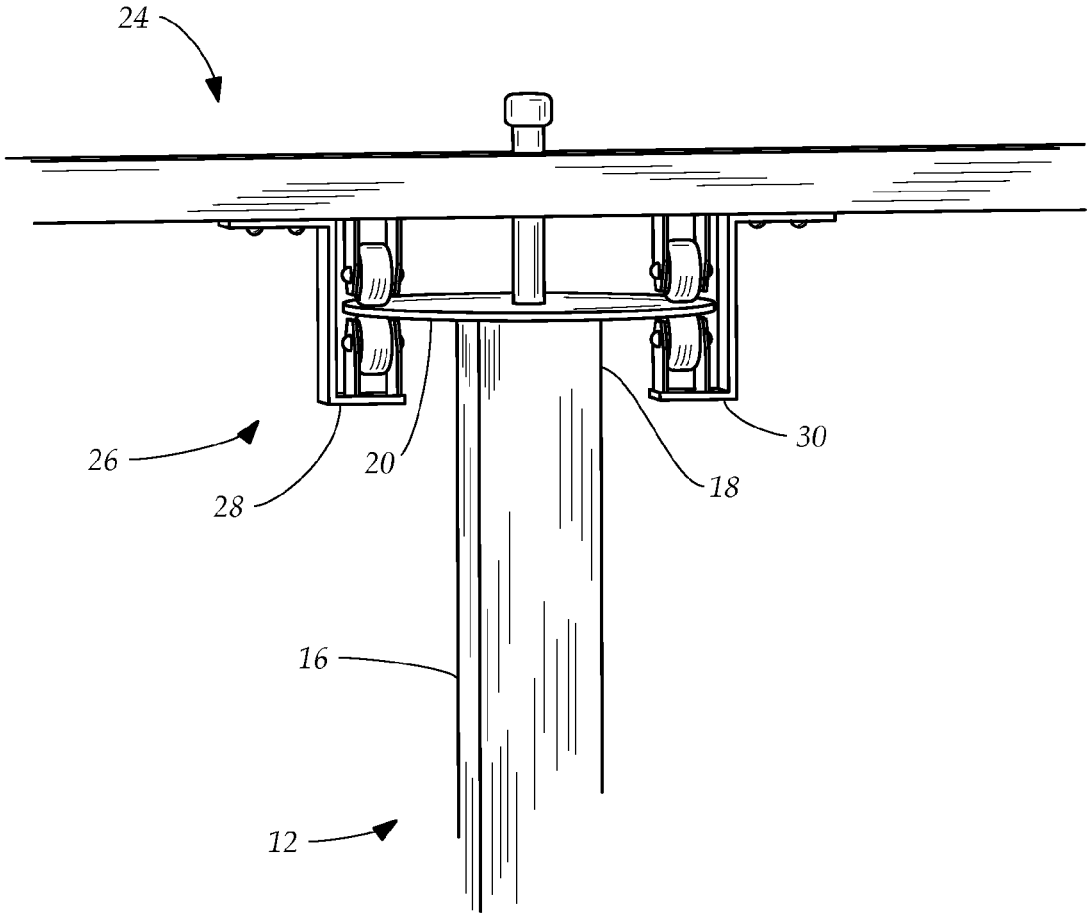
FIG. 2 is an enlarged view of one embodiment of a bearing assembly for the roundabout of FIG. 1.
Figure 3A:
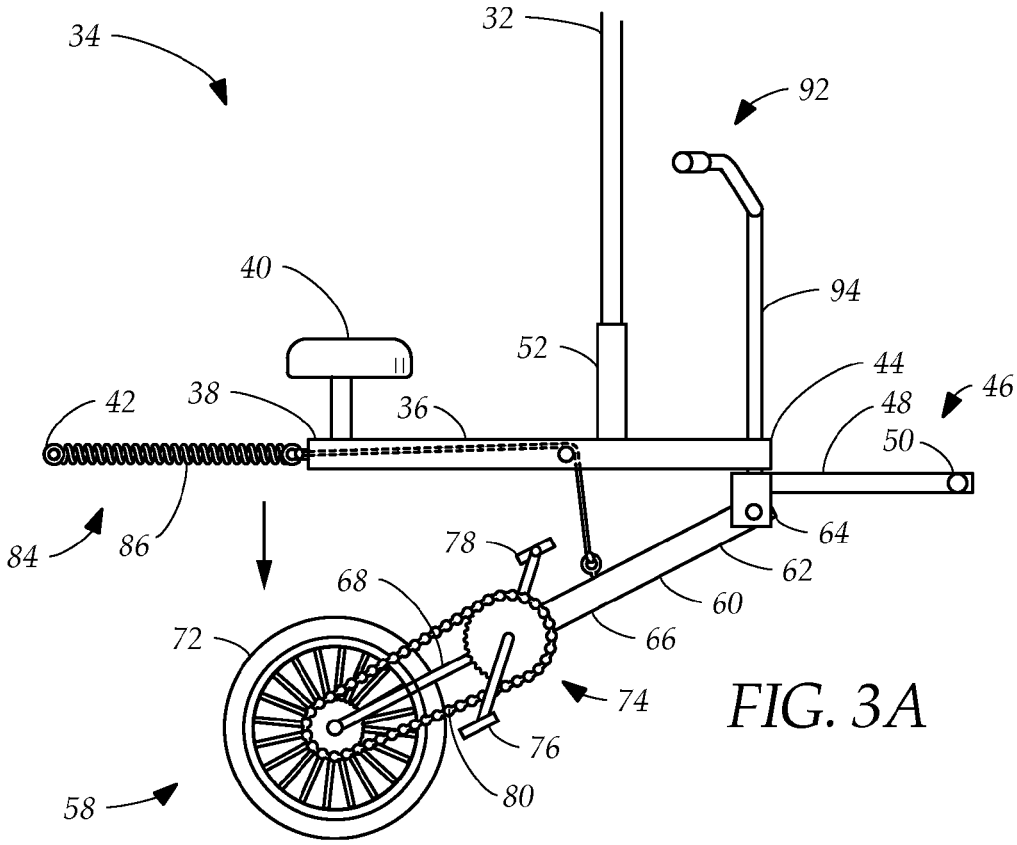
FIG. 3A is a side view of the roundabout of FIG. 1, showing one of the drive mechanisms moved to a deployed position with respect to one of the seat assemblies.
Figure 3B:
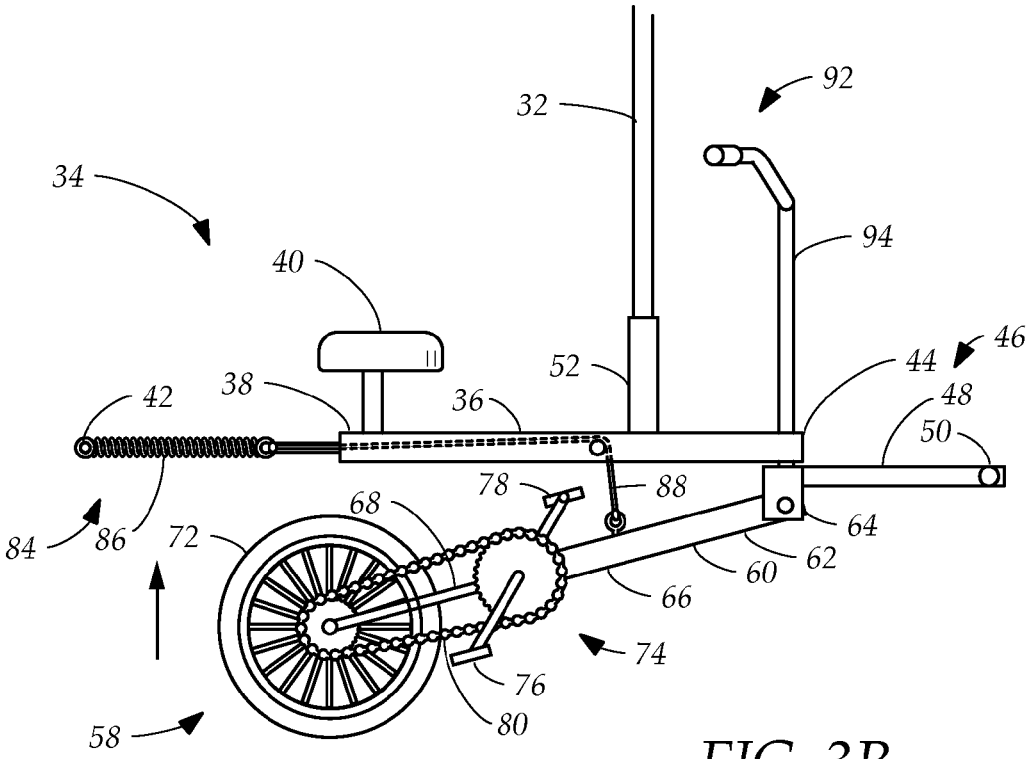
FIG. 3B is a side view of the roundabout of FIG. 3A, showing the drive mechanism moved to a retracted position with respect to the seat assembly.

Referring to FIG. 1, the roundabout 10 may also have a carrier 22 rotatably carried by the post 16 by, for example, a center pin 23 or bolt member. The carrier 22 in this form may include a cross bar 24 and a bearing assembly 26 (FIG. 2) that may be carried by a central portion of the cross bar 24. The bearing assembly 26 may have a first pair of roller bearings 28 that may sandwich the annular flange 20 therebetween and a second pair of roller bearings 30 that may sandwich the annular flange 20 therebetween. As best shown in FIGS. 1, 3A and 3B, the carrier 22 may also have a first pillar 32 pivotally carried by one end of the cross bar 24. As best shown in FIGS. 3A and 3B, the carrier 22 may also have a first seat assembly 34, which may be carried by the first pillar 32 and may be adapted to carry a first occupant. The first seat assembly 34 in this form may include a tube 36 having a rear portion 38. The first seat assembly 34 may also have a seat 40 carried by the rear portion 38 of the tube 36. Furthermore, the first seat assembly 34 may have an anchor member 42 carried by the rear portion 38 of the tube 36. The anchor member 42 in this form may be a rod extending from the rear portion 38 of the tube 36. In addition, the first seat assembly 34 may also have a front portion 44 opposite the rear portion 38 and a pedestal 46 carried by the front portion 44 to support feet of the first occupant. The pedestal 46 in this form may be a leg 48 or bar that may extend from the front portion 44 of the tube 36 and terminate with a pair of pegs 50, 51 extending diametrically therefrom. The first seat assembly 34 may also have a socket 52 that may be communicated with tube 36 and extend perpendicular therefrom. The socket 52 may receive a portion of the first pillar 32 and may be fastened thereto. As shown in FIG. 1, the carrier 22 may also have a second pillar 54 that may be pivotally carried by another end of the cross bar 24 opposite the first pillar 32. The second pillar 54 may be similar to the first pillar 32. In addition, the carrier 22 may also have a second seat assembly 56, which may be carried by the second pillar 54 and may be adapted to carry a second occupant. The second seat assembly 56 may be similar to the first seat assembly 34.

Referring to FIGS. 3A and 3B, the roundabout 10 may also have a first drive mechanism 58 that may be pivotally coupled to the first seat assembly 34. The first drive mechanism 58 may be movable between a deployed position (FIG. 3A) and a retracted position (FIG. 3B), with the first drive mechanism 58 being moved toward the deployed position in response to the first occupant operating the first drive mechanism 58. The first drive mechanism 58 in this form may include an arm pivotally carried by any suitable portion of the carrier 22. For example, the arm 60 may be a post 62 having a first end 64 pivotally carried by the front portion 44 of the first seat assembly 34. The post 16 may have a second end 66 opposite the first end 64. The arm 60 may also include a pair of chainstays 68, 70 extending from the second end 66 of the post 62. In addition, the first drive mechanism 58 may also have a wheel 72 that may be rotatably carried by the chainstays 68, 70 or other portions of the arm 60. In addition, the first drive mechanism 58 may also have a sprocket assembly 74 that may be rotatably carried by the second end 66 of the post 62 or any suitable portion of the arm 60. The sprocket assembly 74 may also include a pair of pedals 76, 78, such that the first drive mechanism 58 may be moved to the deployed position in response to the first occupant operating the pair of pedals 76, 78. The first drive mechanism 58 may also have a chain 80 operably interconnecting the sprocket assembly 74 and the wheel 72 such that the wheel 72 rotates in response to the first occupant operating the pair of pedals 76, 78.

As shown in FIG. 1, the roundabout 10 may also have a second drive mechanism 82 that may be pivotally carried by the second seat assembly 56. The second seat assembly 82 may be similar to the first seat assembly 34.

Referring to FIGS. 3A and 3B, the roundabout 10 may also have a first biasing member 84 that may be operably connected between the first drive mechanism 58 and the carrier 22. The first biasing member 84 in this form may include a helical spring 86 carried by the anchor member 42. The first biasing member 84 may also include a line 88 interconnecting the helical spring 86 and the first drive mechanism 58, such that the helical spring 86 pulls the first drive mechanism 58 toward the retracted position. Of course, the first biasing member may instead have other suitable components that may, for example, include a torsional spring (not shown) interconnecting the first end 64 of the post 62 and the front portion 44 of the first seat assembly 34.

As shown in FIG. 1, the roundabout 10 may also have a second biasing member 90 that may be operably connected between the second drive mechanism 82 and the carrier 22. The second biasing member 90 may be substantially similar to the first biasing member 84.

Figure 4A:
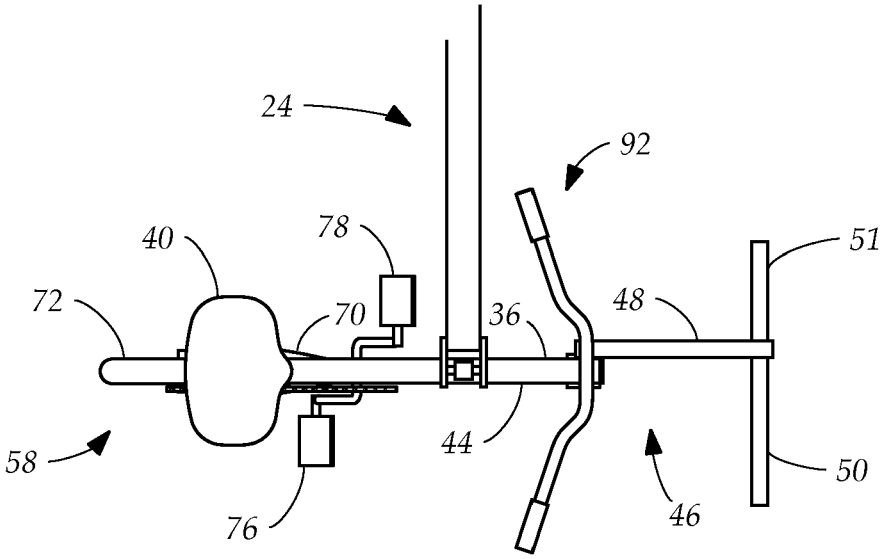
FIG. 4A is a top view of the roundabout of FIG. 1, showing the one of the drive mechanisms moved to a straight position.
Figure 4B:
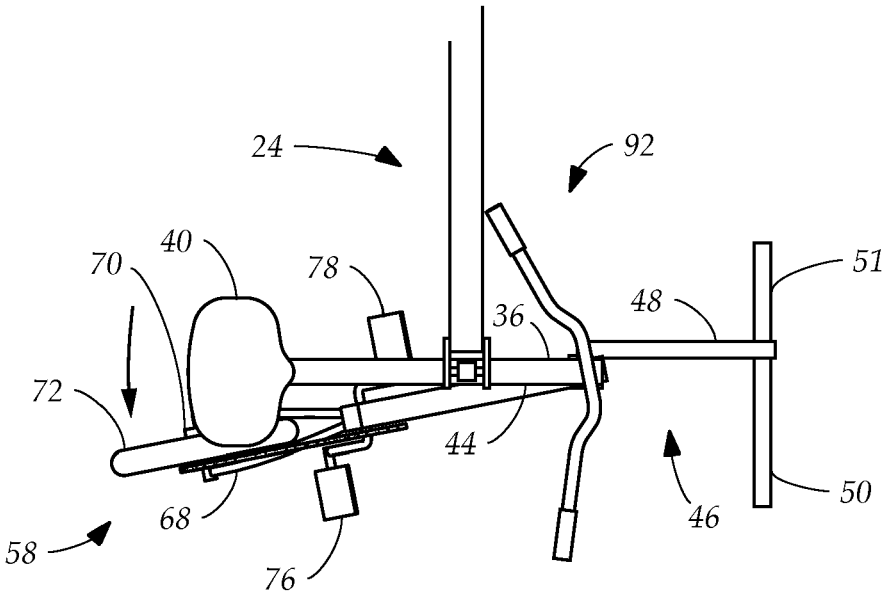
FIG. 4B is a top view of the roundabout of FIG. 4A, showing the drive mechanism moved to a pivoted position.

Referring to FIGS. 1, 4A and 4B, the first seat assembly 34 in this form may also include a handle assembly 92 having a steering post 94 that may be pivotally carried by the front portion 44 of the tube 36 or any other suitable portion of the carrier 22, so that the steering post 94 may pivot about a first axis to direct the wheel 72 a predetermined number of degrees radially inward. In addition, the first drive mechanism 58 in this form may be pivotally carried by the steering post 94. Specifically, the steering post 94 may terminate with a clevis that pivotally carries the post 60 of the first drive mechanism 58 thereby permitting the first drive mechanism 58 to pivot about a second axis that is perpendicular to the first axis. Of course, the first drive mechanism 58 may instead terminate with a clevis that pivotally carries the steering post. In addition, it is also contemplated that the steering post 94 may be carried by the tube in one fixed position and the wheel 72 may have tire tread configured to provide better lateral acceleration in one direction. For example, the tire tread (not shown) may include ridges extending somewhat radially inward from a rear portion of the tread toward a forward portion of the tread.

Figure 5A:
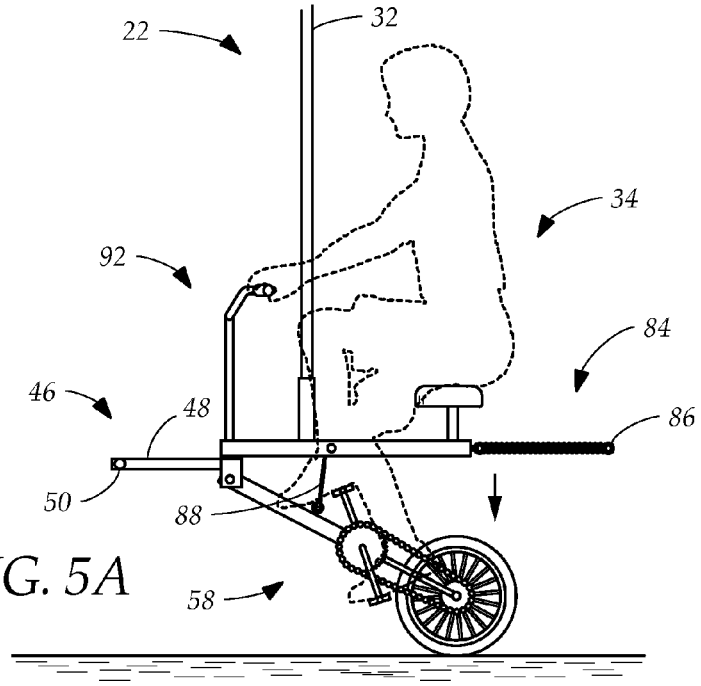
FIG. 5A is a side view of the roundabout of FIG. 1, showing an occupant operating one of the drive mechanisms thereby moving the drive mechanism to its deployed position.
Figure 5B:
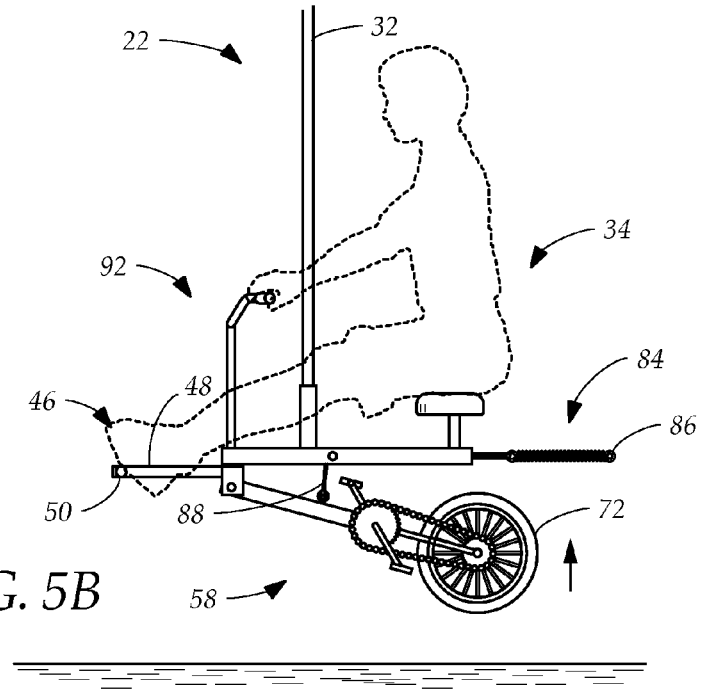
FIG. 5B is a side view of the roundabout of FIG. 5B, showing the occupant resting his or her feet on a pedestal thereby permitting the first biasing member to move the first drive mechanism to its retracted position.

Referring now to FIGS. 1, 5A and 5B, one embodiment of a method for operating the roundabout 10 may include supporting two occupants on seats 40 of a respective one of the first and second seat assemblies 34, 56. As shown in FIG. 5A, the first occupant may operate the first drive mechanism 58 by, for example, operating the pedals 76, 78 with his or her feet. The first drive mechanism 58 may move toward its deployed position and the wheel 72 may accelerate the roundabout 10 with respect to the ground, in response to the first occupant operating the first drive mechanism 58. In so doing, the helical spring 86 may stretch toward an elongated position in response to the first drive mechanism 58 moving to its deployed position. The method may also include pivoting the handle assembly 92 radially inward with respect to a circular path of the seat assemblies thereby pivoting the first drive mechanism 58 radially inward to provide better traction of the wheel at generally higher speeds and reduce any skidding. The method may also include disengaging the first drive mechanism 58 when, for example, the roundabout 10 is spinning at a desired speed. For example, the first occupant may move his or her feet from the pedals 76, 78 to the pedestal 46. Accordingly, the first biasing member 84 may move the first drive mechanism 58 toward its retracted position (FIG. 5B) above the ground thereby eliminating rolling friction of the first drive mechanism and increasing the length of time in which the roundabout 10 may spin. In so doing, the helical spring 86 may return toward its original non-elongated position in response to the occupant disengaging the first drive mechanism 58. The second occupant on the second seat assembly 56 may operate and disengage the second drive mechanism 84 in a similar manner as the first occupant operates and disengages the first drive mechanism 58.

Figure 6A:
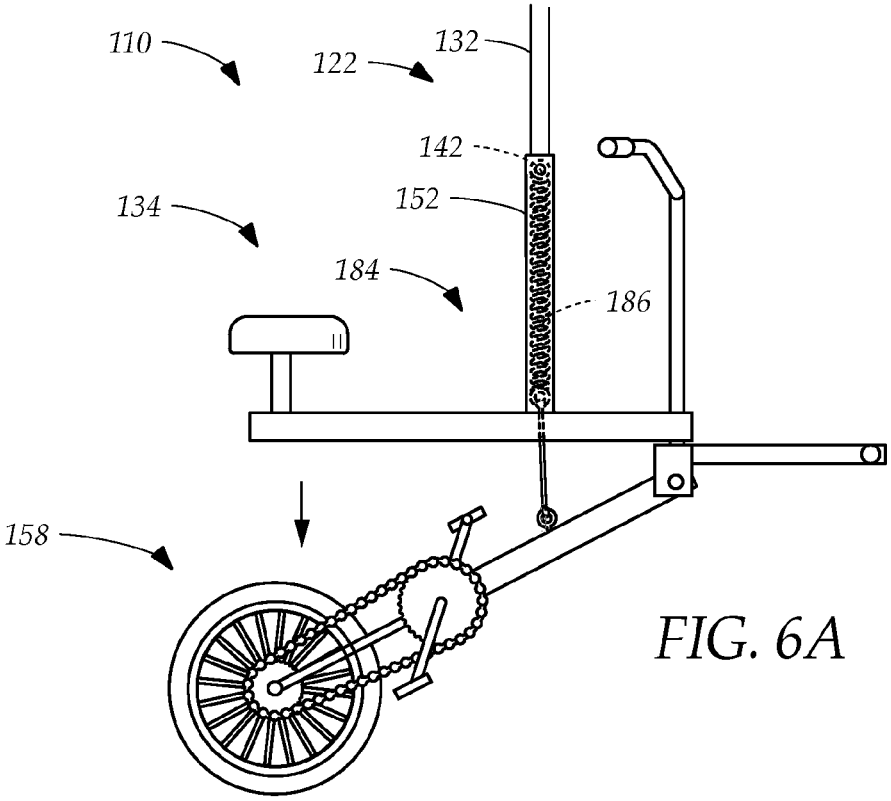
FIG. 6A is a side view of another embodiment of a roundabout, showing the carrier having a drive mechanism moved to a deployed position.
Figure 6B:
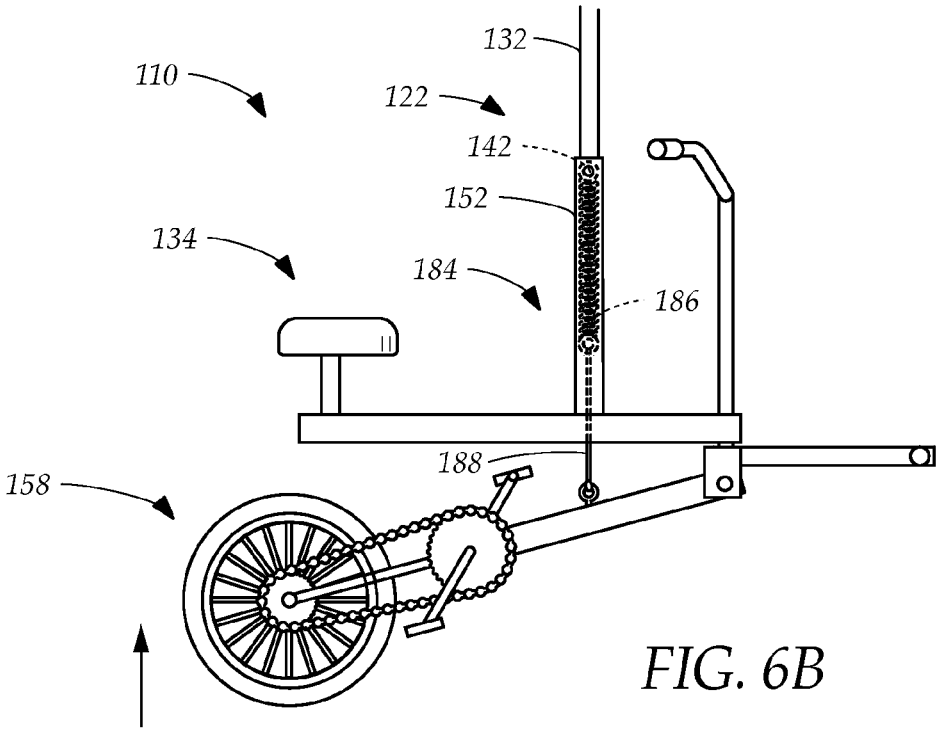
FIG. 6B is a side view of the roundabout of FIG. 6A, showing the drive mechanism moved to a retracted position.

Referring now to FIGS. 6A and 6B, another embodiment of a roundabout 110 may include a carrier 122, a first seat assembly 134, a first drive mechanism 158 and a first biasing member 184. The roundabout 110 may be substantially similar to the roundabout 10 of FIGS. 3A and 3B. However, the carrier 122 may have an anchor member 142 that may be carried by the socket 152 or the first pillar 132, as compared to the anchor member 42 of FIGS. 3A and 3B being carried by the rear portion 38 of the tube 36. In this respect, the first biasing member 184 may have a helical spring 186 that may be disposed or at least partially enclosed within the socket 152 and thereby protected from dust, debris and moisture or condensation. In addition, the roundabout 110 may also have a second seat assembly, a second drive mechanism and a second biasing member that are similar to a respective one of the first seat assembly 134, the first drive mechanism 158 and the first biasing member 184.

The exemplary embodiments described herein detail for illustrative purposes are subject to many variations in structure and design. It should be emphasized, however, that the present disclosure is not limited to an occupant propelled roundabout having two seat assemblies, two drive mechanisms and two biasing members as shown and described. For example, the roundabout may instead have three or more of the aforementioned components such that three or more occupants may operate the roundabout. Conversely, the roundabout may have only one of each aforementioned component with the second components being replaced by a counterweight mechanism such that the roundabout may be operated by only one occupant. It is understood that various omissions and substitutions of equivalents are contemplated as circumstances may suggest or render expedient, but these are intended to cover the application or implementation without departing from the spirit or scope of the claims of the present disclosure. Also, it is to be understood that the phraseology and terminology used herein is for the purpose of description and should not be regarded as limiting.

The foregoing descriptions of specific embodiments of the present disclosure have been presented for purposes of illustration and description. They are not intended to be exhaustive or to limit the present disclosure to the precise forms disclosed, and obviously many modifications and variations are possible in light of the above teaching. The embodiments were chosen and described in order to best explain the principles of the present disclosure and its practical application, to thereby enable others skilled in the art to best utilize the present disclosure and various embodiments with various modifications as are suited to the particular use contemplated. It is understood that various omission and substitutions of equivalents are contemplated as circumstance may suggest or render expedient, but such are intended to cover the application or implementation without departing from the spirit or scope of the claims of the present disclosure.

What is claimed is:

1. An occupant propelled roundabout, comprising:

a body;

a carrier rotatably carried by the body and having a seat assembly adapted to carry an occupant;

a drive mechanism pivotally coupled to the seat assembly such that the drive mechanism is movable between a deployed position and a retracted position, wherein the drive mechanism is moved toward the deployed position in response to the occupant operating the drive mechanism; and a biasing member operably connected between the drive mechanism and the carrier so that the biasing member moves the drive mechanism toward the retracted position.

2. The occupant propelled roundabout of claim 1, wherein the drive mechanism comprises:

an arm pivotally carried by the carrier;

a wheel rotatably carried by the arm;

a sprocket assembly rotatably carried by the arm, and the sprocket assembly including a pair of pedals such that the drive mechanism is moved to the deployed position in response to the occupant operating the pair of pedals; and a chain operably interconnecting the sprocket and the wheel such that the wheel rotates in response to the occupant operating the pair of pedals.

3. The occupant propelled roundabout of claim 2, wherein the arm comprises:

a post having a first end pivotally carried by the carrier and a second end rotatably carrying the sprocket assembly; and a pair of chainstays extending from the second end of the post, with the pair of chainstays carrying the wheel.

4. The occupant propelled roundabout of claim 1, wherein the seat assembly has a rear portion carrying a seat adapted for carrying the occupant, and the seat assembly also having front portion carrying a pedestal adapted to support feet of the occupant.

5. The occupant propelled roundabout of claim 1, wherein the seat assembly includes a tube and a socket that is communicated with the tube and perpendicular thereto, and the tube has a rear portion carrying a seat adapted to carry the occupant.

6. The occupant propelled roundabout of claim 5, wherein the seat assembly further includes an anchor member extending from the rear portion of the tube, whereby the biasing member includes a spring carried by the anchor member and a line interconnecting the spring and the drive mechanism such that the spring pulls the drive mechanism toward the retracted position.

7. The occupant propelled roundabout of claim 5, wherein the carrier further includes a pillar having an end portion received within the socket of the seat assembly, whereby the biasing member includes a spring carried by one of the pillar and the socket, and the biasing member also has a line that interconnects the spring and the drive mechanism such that the spring pulls the drive mechanism toward the retracted position.

8. The occupant propelled roundabout of claim 5, wherein the tube has a front portion opposite the rear portion, and the seat assembly also includes a handle assembly carried by the front portion.

9. The occupant propelled roundabout of claim 8, wherein the handle assembly includes a steering post pivotally carried by the front portion of the tube to permit the steering post to pivot about a first axis, and the drive mechanism is pivotally carried by the steering post such that the drive mechanism pivots about a second axis that is perpendicular to the first axis.

10. The occupant propelled roundabout of claim 9, wherein one of the steering post and the drive mechanism terminates with a clevis pivotally carried by the other of the steering post and the drive mechanism.

11. An occupant propelled roundabout, comprising:

a body having a base, and the body also having a post extending from the base;

a carrier having a cross bar that is rotatably carried by the post, the carrier also having a first pillar carried by one end of the cross bar and a second pillar carried by the other end of the cross bar, the carrier also having a first seat assembly that is carried by the first pillar and adapted to carry a first occupant, and the carrier also having a second seat assembly that is carried by the second pillar and adapted to carry a second occupant;

a first drive mechanism pivotally coupled to the first seat assembly;

a second drive mechanism pivotally coupled to the second seat assembly, such that the first and second drive mechanisms are movable between a deployed position and a retracted position, wherein the first drive mechanism is moved toward the deployed position in response to the first occupant operating the first drive mechanism and the second drive mechanism is moved toward the deployed position in response to the second occupant operating the second drive mechanism; and a first biasing member operably connected between the first drive mechanism and the carrier;

a second biasing member operably connected between the second drive mechanism and the carrier, such that the first and second biasing members move a respective one of the first and second drive mechanisms toward the retracted position.

12. The occupant propelled roundabout of claim 11, wherein the cross bar includes a central portion and a bearing assembly carried by the central portion, such that the bearing assembly engages the post to facilitate the rotation of the cross bar on the post.

13. The occupant propelled roundabout of claim 11, wherein the post includes an end portion having an annular flange that supports the bearing assembly of the cross bar.

14. The occupant propelled roundabout of claim 13, wherein the bearing assembly includes a first pair of roller bearings rotatably carried on the cross bar such that the annular flange is received between the first pair of roller bearings, and the bearing assembly also includes a second pair of roller bearings rotatably carried on the cross bar such that the annular flange is sandwiched between the second pair of roller bearings.

15. The occupant propelled roundabout of claim 11, wherein the first pillar is pivotally carried by one end of the cross bar, and the second pillar is pivotally carried by the other end of the cross bar.

16. A method for operating an occupant propelled roundabout, the method comprising:

supporting an occupant on a seat assembly;

operating a drive mechanism pivotally carried by the seat assembly, such that the drive mechanism moves toward a deployed position and a wheel of the drive mechanism rolls along the ground;

disengaging the drive mechanism such that a biasing member interconnecting the seat assembly and the drive mechanism moves the drive mechanism toward a retracted position.

17. The method of claim 16, further comprising:

pivoting a handle assembly radially inward with respect to a circular path of the seat assembly; and pivoting the drive mechanism radially inward with respect to a circular path of the seat assembly.

18. The method of claim 16, further comprising supporting the feet of the occupant on a pedestal of the seat assembly.

19. The method of claim 16, further comprising elongating a biasing member to an elongated position in response to operating the drive mechanism.

20. The method of claim 16, further comprising returning the biasing member to non-elongated position in response to disengaging the drive mechanism.

* * * * *